US009750989B2

(12) United States Patent
Ogawa et al.

(10) Patent No.: US 9,750,989 B2
(45) Date of Patent: Sep. 5, 2017

(54) RACKET AND GROMMET

(71) Applicant: Yonex Kabushiki Kaisha, Tokyo (JP)

(72) Inventors: Naoto Ogawa, Nagaoka (JP); Junya Suetake, Nagaoka (JP)

(73) Assignee: Yonex Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/899,750

(22) PCT Filed: Jun. 18, 2014

(86) PCT No.: PCT/JP2014/066142
§ 371 (c)(1),
(2) Date: Dec. 18, 2015

(87) PCT Pub. No.: WO2015/177937
PCT Pub. Date: Nov. 26, 2015

(65) Prior Publication Data

US 2017/0173407 A1 Jun. 22, 2017

(30) Foreign Application Priority Data

May 20, 2014 (JP) ..... 2014-103998

(51) Int. Cl.
*A63B 51/10* (2015.01)
*A63B 49/02* (2015.01)
*A63B 49/022* (2015.01)

(52) U.S. Cl.
CPC ..... *A63B 49/022* (2015.10); *A63B 51/10* (2013.01)

(58) Field of Classification Search
CPC ..... A63B 49/02; A63B 49/022; A63B 51/10
See application file for complete search history.

(56) References Cited

U.S. PATENT DOCUMENTS 4,930,778 A 6/1990 Mizuno
5,332,213 A * 7/1994 Klose ..... A63B 49/022 473/522

(Continued)

FOREIGN PATENT DOCUMENTS

EP 0884074 A2 * 12/1998 ..... A63B 49/00
JP S60-028463 Y2 8/1985

(Continued)

OTHER PUBLICATIONS

CN Office Action for parallel application CN 201480023234.6, issued Sep. 2, 2016.

(Continued)

*Primary Examiner* — Raleigh W Chiu
(74) *Attorney, Agent, or Firm* — Harness, Dickey & Pierce, P.L.C.

(57) ABSTRACT

A racket including: a grip; an annular frame provided with a plurality of through holes extending through from an inner peripheral face to an outer peripheral face; a shaft connecting the grip and the frame; and a grommet to be attached to the outer peripheral face of the frame, the grommet including: a plurality of tube sections to be inserted into each of the plurality of through holes provided to the frame; and a base section that connects the plurality of tube sections to one another, the tube sections each including a communicating hole that communicates a base section side opening on the base section side with a tip end side opening on the side to be inserted through the through hole, the tip end side openings of at least some number of the tube sections, of the plurality of tube sections through which a string to be strung in a direction along a longitudinal direction of the racket is inserted, being wider than the base section side openings in a direction in which the plurality of tube sections is arranged.

5 Claims, 7 Drawing Sheets

(56) References Cited

U.S. PATENT DOCUMENTS 5,833,560 A * 11/1998 Davis ..... A63B 49/00 473/537
2007/0238560 A1* 10/2007 Gazzara ..... A63B 51/00 473/516
2009/0017948 A1* 1/2009 Ashino ..... A63B 49/022 473/522
2009/0165243 A1* 7/2009 Yazdi ..... A63B 49/025 16/2.1
2010/0331126 A1* 12/2010 Iizawa ..... A63B 49/022 473/521
2011/0152016 A1 6/2011 Gazzara et al.
2011/0165975 A1* 7/2011 Bothwell ..... A63B 51/00 473/535
2013/0023363 A1* 1/2013 Doyle ..... A63B 49/022 473/522
2014/0256480 A1* 9/2014 Ogawa ..... A63B 51/00 473/543
2014/0296005 A1* 10/2014 Yamamoto ..... A63B 60/42 473/519
2014/0335979 A1* 11/2014 Grimes ..... A63B 59/0092 473/522
2015/0157902 A1* 6/2015 Mohr ..... A63B 49/002 473/539

FOREIGN PATENT DOCUMENTS

JP S63-020867 U 2/1988
JP 2003-225330 A 8/2003
JP 3981276 B2 9/2007
WO WO 9828049 A1 * 7/1998 ..... A63B 49/00

OTHER PUBLICATIONS

International Search Report and Written Opinion of the ISA for PCT/JP2014/066142, ISA/JP, mailed Jul. 22, 2014.

* cited by examiner

RACKET AND GROMMET

CROSS-REFERENCE TO RELATED APPLICATIONS

This application is a 371 U.S. National Stage of International Application No. PCT/JP2014/066142, filed Jun. 18, 2014, which claims the benefit of and priority to Japanese Patent Application No. 2014103998, filed May 20, 2014. The entire disclosures of the above applications are incorporated herein by reference.

TECHNICAL FIELD

The present invention relates to a racket used in tennis and the like, and a grommet to be attached to the racket.

BACKGROUND ART

A frame of the racket used in tennis and the like is provided with a plurality of string holes through which strings are inserted, along the circumferential direction of the frame. Generally, the string is strung to the frame through a grommet having a plurality of tube sections and a base section that connects these tube sections. Then, the net-like hitting surface is formed by the strings strung to the frame.

Patent Literature 1 discloses a string protector having a through hole through which the string slides in a pressing direction to obtain a wide sweet area.

CITATION LIST

Patent Literature

[Patent Literature 1] Japanese Patent Application Laid-open Publication No. 2003-225330

SUMMARY OF THE INVENTION

Technical Problem

If the number of rotations of a hit ball can be increased in a tennis game, a player will have many advantages such that the hit ball may be easily fallen into the opponent's court. Thus, it is desirable that the number of rotations of the hit ball is increased.

The present invention has been made in view of the above issue, and an advantage thereof is to increase the number of rotations of the hit ball.

Solution to Problem

A principal aspect of the present invention to achieve the above advantage is a racket including:

a grip;

an annular frame provided with a plurality of through holes extending through from an inner peripheral face to an outer peripheral face;

a shaft connecting the grip and the frame; and a grommet to be attached to the outer peripheral face of the frame, the grommet including:

a plurality of tube sections to be inserted into each of the plurality of through holes provided to the frame; and a base section that connects the plurality of tube sections to one another, the tube sections each including a communicating hole that communicates a base section side opening on the base section side with a tip end side opening on the side to be inserted through the through hole, the tip end side openings of at least some number of the tube sections, of the plurality of tube sections through which a string to be strung in a direction along a longitudinal direction of the racket is inserted, being wider than the base section side openings in a direction in which the plurality of tube sections is arranged, the base section side opening is a round hole, and the tip end side opening is an elongated hole having a longer diameter in a direction in which the tube sections are arranged.

Other features of the present invention will become apparent from the description in this specification and the drawings.

Effects of the Invention

According to a racket of the present invention, the tip end side opening of the grommet is wider than the base section side opening in a direction in which a plurality of tube sections is arranged, and this makes it easier for the strings that are to be strung in the direction along the longitudinal direction of the racket (hereinafter, referred to as longitudinal strings) to move more largely toward the direction intersecting with the longitudinal direction (hereinafter, intersecting direction) when hitting a ball so as to rub the ball upward. Further, the longitudinal strings move with a base section side opening side as a support point, and thus the strings return to the original positions while being in contact with the ball immediately after moving in the intersecting direction. In this way, the displacement of the longitudinal strings while being in contact with the ball can be increased in comparison with a common racket. The number of rotations of the hit ball can be increased with the above-mentioned racket, because the number of rotations of the hit ball increases corresponding to the displacement of the strings while being in contact with the ball.

DESCRIPTION OF EMBODIMENTS

===Overview of Disclosure===

Figure 1:
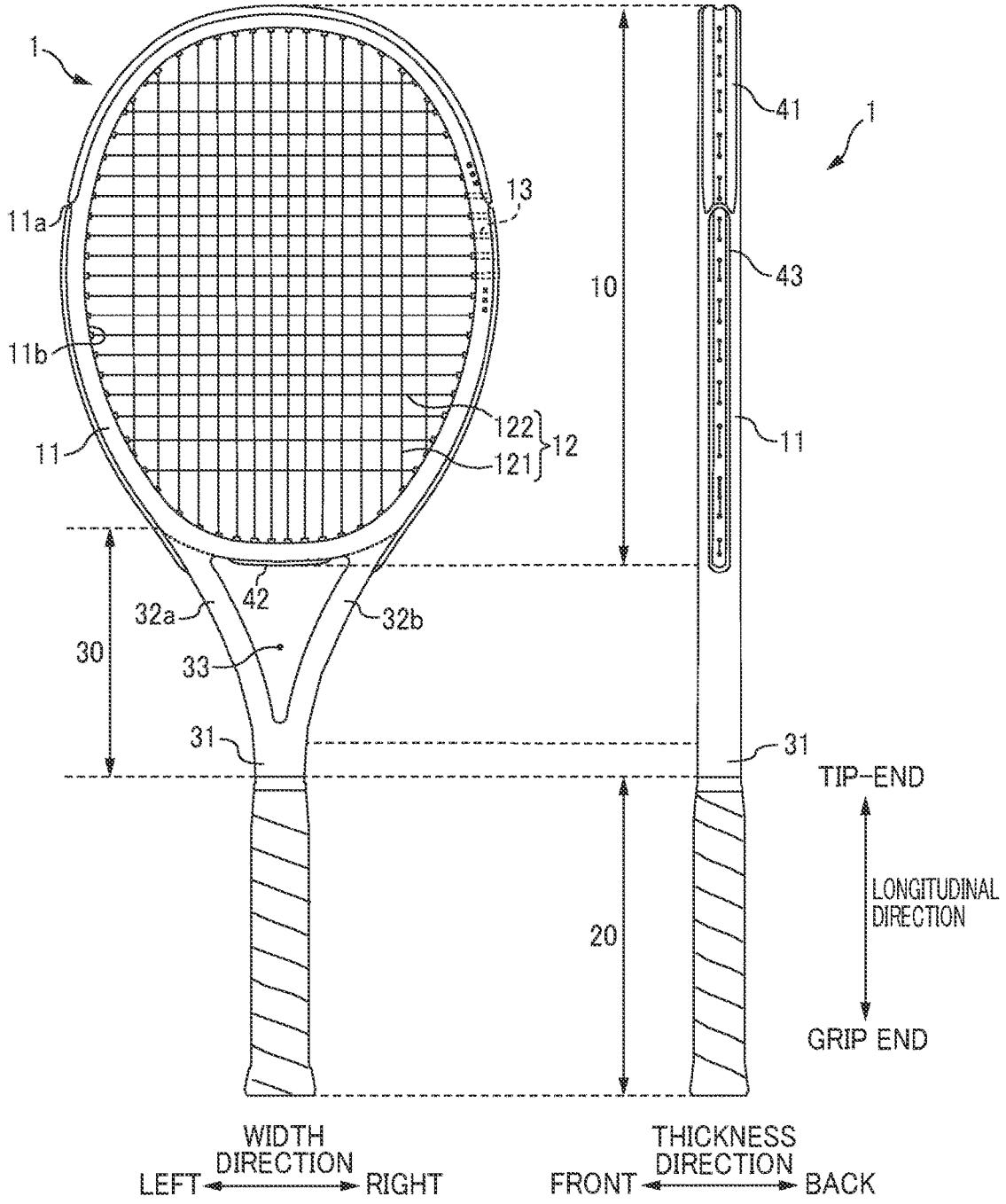
FIG. 1 is a plan view and a side view of a tennis racket.

At least the following matters will be made clear by the description in the present specification and the drawings.

Specifically, a racket including:

a grip;

an annular frame provided with a plurality of through holes extending through from an inner peripheral face to an outer peripheral face;

a shaft connecting the grip and the frame; and a grommet to be attached to the outer peripheral face of the frame, the grommet including:

- a plurality of tube sections to be inserted into each of the plurality of through holes provided to the frame; and
- a base section that connects the plurality of tube sections to one another, the tube sections each including a communicating hole that communicates a base section side opening on the base section side with a tip end side opening on the side to be inserted through the through hole, the tip end side openings of at least some number of the tube sections, of the plurality of tube sections through which a string to be strung in a direction along a longitudinal direction of the racket is inserted, being wider than the base section side openings in a direction in which the plurality of tube sections is arranged.

According to such a racket, the tip end side opening of the grommet is wider than the base section side opening in a direction in which a plurality of tube sections is arranged, and this makes it easier for the strings that are to be strung in the direction along the longitudinal direction of the racket (hereinafter, referred to as longitudinal strings) to move more largely toward the direction intersecting with the longitudinal direction (hereinafter, intersecting direction) when hitting a ball so as to rub the ball upward. Moreover, the longitudinal strings move with the base section side opening side as a support point, and thus the longitudinal strings return to the original positions while being in contact with the ball immediately after moving to the intersecting direction. In this way, the displacement of the longitudinal strings while being brought into contact with the ball can be increased compared with a common racket. The number of rotations of the hit ball can be increased with the above-mentioned racket because the number of rotations of the hit ball is increased corresponding to the displacement of the strings while being in contact with the ball.

In the above racket, the grommet is attached to at least either one of the tip end side or the grip end side of the frame in the longitudinal direction.

Consequently, the longitudinal strings can be strung in at least some number of the tube sections of the above-mentioned grommet. Then, the number of rotations can be increased by increasing the displacement of the longitudinal strings.

In the above racket, the base section side opening is a round hole, and the tip end side opening is an elongated hole having a longer diameter in a direction in which the tube sections are arranged.

Consequently, the tip end side opening can be made wider than the base section side opening in the direction in which the plurality of tube sections is arranged.

Further, the size of the base section side opening and the size of the tip end side opening are equal with each other in a direction intersecting with the direction in which the tube sections are arranged.

Consequently, when the grommet is attached to the racket, the diameter of the base section side opening and the diameter of the tip end side opening can be made equal with each other in the thickness direction of the racket. Thus, the longitudinal strings can be moved along the direction in which the plurality of tube sections is arranged.

Moreover, the racket further includes a side grommet having a plurality of tube sections through which the string to be strung along a direction intersecting with the longitudinal direction is inserted, and at least some number of the tube sections, of the tube sections of the side grommet, each have an elongated hole extending in the thickness direction of the racket.

Consequently, when coming into contact with the ball, the strings to be strung in the direction along the intersecting direction (hereinafter, referred to as transverse strings) can be made easier to move in the thickness direction of the racket. Although this allows a repulsive force of the ball to be increased against the racket, the number of rotations of the ball in the forward direction can be increased with such an above-mentioned configuration, so that the ball is allowed to appropriately fall into the opponent's court.

Further, at least the following matters will be also made clear by the description in the present specification and the drawings.

Specifically, a racket including:

a grip;

an annular frame provided with a plurality of through holes extending through from an inner peripheral face to an outer peripheral face; and a shaft connecting the grip and the frame, the through holes each including an outer peripheral face side opening on the outer peripheral face and an inner peripheral face side opening on the inner peripheral face side, the inner peripheral side openings of at least some number of the through holes, of the plurality of through holes through which a string to be strung in a direction along the longitudinal direction of the racket is inserted, being wider than the outer peripheral side openings in a direction in which the plurality of through holes is arranged.

According to such a racket, the inner peripheral side opening is wider than the outer peripheral side opening in the direction in which a plurality of tube sections is arranged, and this makes it easier for the longitudinal strings to move more largely toward the intersecting direction when hitting a ball so as to rub the ball upward. Moreover, the longitudinal strings move with the outer peripheral side opening side as a support point, and thus the longitudinal strings return to the original positions while being in contact with the ball immediately after moving in the intersecting direction. In this way, the displacement of the longitudinal strings while being in contact with the ball can be increased in comparison with a common racket. The number of rotations of the hit ball can be increased with the above-mentioned racket because the number of rotations of the hit ball is increased corresponding to the displacement of the strings while being in contact with the ball.

Further, at least the following matters will be also made clear by the description in the present specification and the drawings.

Specifically, a grommet to be attached to a racket, the racket including a grip, an annular frame provided with a plurality of through holes extending through from an inner peripheral face to an outer peripheral face, and a shaft connecting the grip and the frame, the grommet including:

a plurality of tube sections to be inserted into each of the plurality of through holes provided to the frame; and a base section that connects the plurality of tube sections to one another, the tube sections each including a communicating hole that communicates a base section side opening on the base section side with a tip end side opening on the side to be inserted through the through hole, the tip end side openings of at least some number of the tube sections, of the plurality of tube sections through which a string to be strung in a direction along a longitudinal direction of the racket is inserted, being wider than the base section side openings in a direction in which the plurality of tube sections is arranged.

According to such a grommet, the tip end side opening of the grommet is wider than the base section side opening in a direction in which a plurality of tube sections is arranged, and this makes it easier for the longitudinal strings to move more largely toward the intersecting direction when hitting a ball so as to rub the ball upward. Moreover, the longitudinal strings move with the base section side opening side as a support point, and thus the strings return to the original positions while being in contact with the ball immediately after moving in the intersecting direction. In this way, the displacement of the longitudinal strings while being in contact with the ball can be increased in comparison with a common racket. The number of rotations of the hit ball can be increased with the above-mentioned grommet because the number of rotations of the hit ball is increased corresponding to the displacement of the strings while being in contact with the ball.

===Racket 1===

An embodiment of a tennis racket will be described below as an example.

Figure 2:
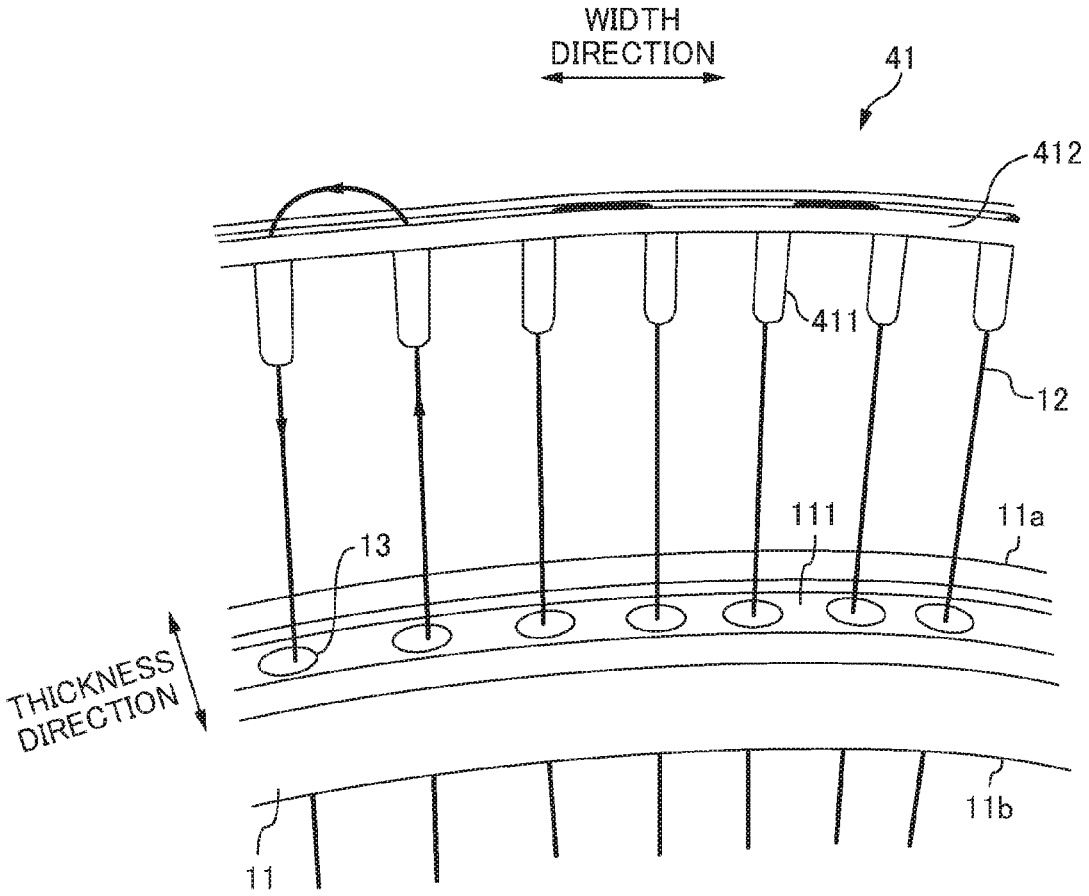
FIG. 2 is a diagram illustrating how a string 12 is strung to a frame 11.

FIG. 1 is a plan view and a side view of a tennis racket (hereinafter, racket 1). The left one is the plan view and the right one is the side view. FIG. 2 is a diagram illustrating how a string 12 is strung to a frame 11. The racket 1 includes a head 10 which hits a ball, a grip 20 which a player grips to hold the racket 1, and a shaft 30 that integrally connects the head 10 and the grip 20. For the purpose of illustration, the side where the head 10 is located is referred to as a tip-end side, and the side where the grip 20 is located is referred to as a grip end side in the longitudinal direction of the racket 1. Further, the direction orthogonal to the longitudinal direction on the hitting surface of the racket 1 (that is, on a plane along the hitting surface) is referred to as a width direction, and the direction orthogonal to the hitting surface of the racket 1 is referred to as a thickness direction.

The head 10 includes: the frame 11 having a substantially elliptical shape extending in the longitudinal direction; the string 12 strung inside the frame 11; and, a bumper grommet 41, a yoke grommet 42 and a side grommet 43 which are attached to an outer peripheral face 11*a* of the frame 11.

As shown in FIG. 2, at the center portion in the thickness direction of the outer peripheral face 11*a* of the frame 11, a groove section 111 is provided along the entire circumference of the frame 11. The groove section 111 is provided with a string hole 13 (corresponding to a through hole) which penetrates from an inner peripheral face 11*b* to the outer peripheral face 11*a* of the frame 11 and through which the string 12 is inserted. A plurality of string holes 13 is provided along the entire circumference of the frame 11.

How to string the string 12 will be described taking the bumper grommet 41 as an example. Note that, the detailed description of each grommet will be given later.

The bumper grommet 41 includes a plurality of tube sections 411 and a base section 412 that connects the plurality of tube sections 411 to one another. The tube section 411 includes a communicating hole, and the string 12 can be inserted through this communicating hole (details will be described later). The bumper grommet 41 is attached on the outer peripheral face 11*a* of the frame 11 in such a manner that the tip portion of the tube section 411 (that is, the end portion in the side that does not connects to the base section 412) is inserted into the string hole 13 from the outer peripheral face 11*a* side of the frame 11 and the base section 412 is fitted into the groove section 111 of the frame 11.

When the string 12 is strung to the frame 11, the following processes are repeated: the string 12 passes from the inside to the outside of the frame 11 through the tube section 411 of the bumper grommet 41; the string 12 is turned back along the base section 412 of the bumper grommet 41; and the string 12 passes through the next tube section 411. As a result, inside the frame 11, a plurality of longitudinal strings 121 which are portions of the strings 12 extending in the longitudinal direction are strung at intervals in the width direction. Further, a plurality of transverse strings 122 which are portions of the strings 12 extending in the width direction so as to intersect the longitudinal strings 121 are strung at intervals in the longitudinal direction, and the net-like hitting surface is formed.

As shown in the left drawing of FIG. 1, the shaft 30 includes a base end portion 31 connecting to the grip 20, a first branched portion 32*a* extending from the base end portion 31 to the left-side end portion in the width direction of the grip-end side portion of the frame 11, and a second branched portion 32*b* extending from the first base end portion 31 to the right-side end portion in the width direction of the grip-end side portion of the frame 11. That is, the shaft 30 branches into two sections toward the tip-end side in the longitudinal direction (the direction from the grip 20 to the frame 11) as seen from the thickness direction (the direction orthogonal to the hitting surface of the racket 1). Thus, an opening 33 extending in the thickness direction is formed by the grip-end side portion of the frame 11, the first branched portion 32*a* and the second branched portion 32*b*.

===Grommet===

Figure 3:
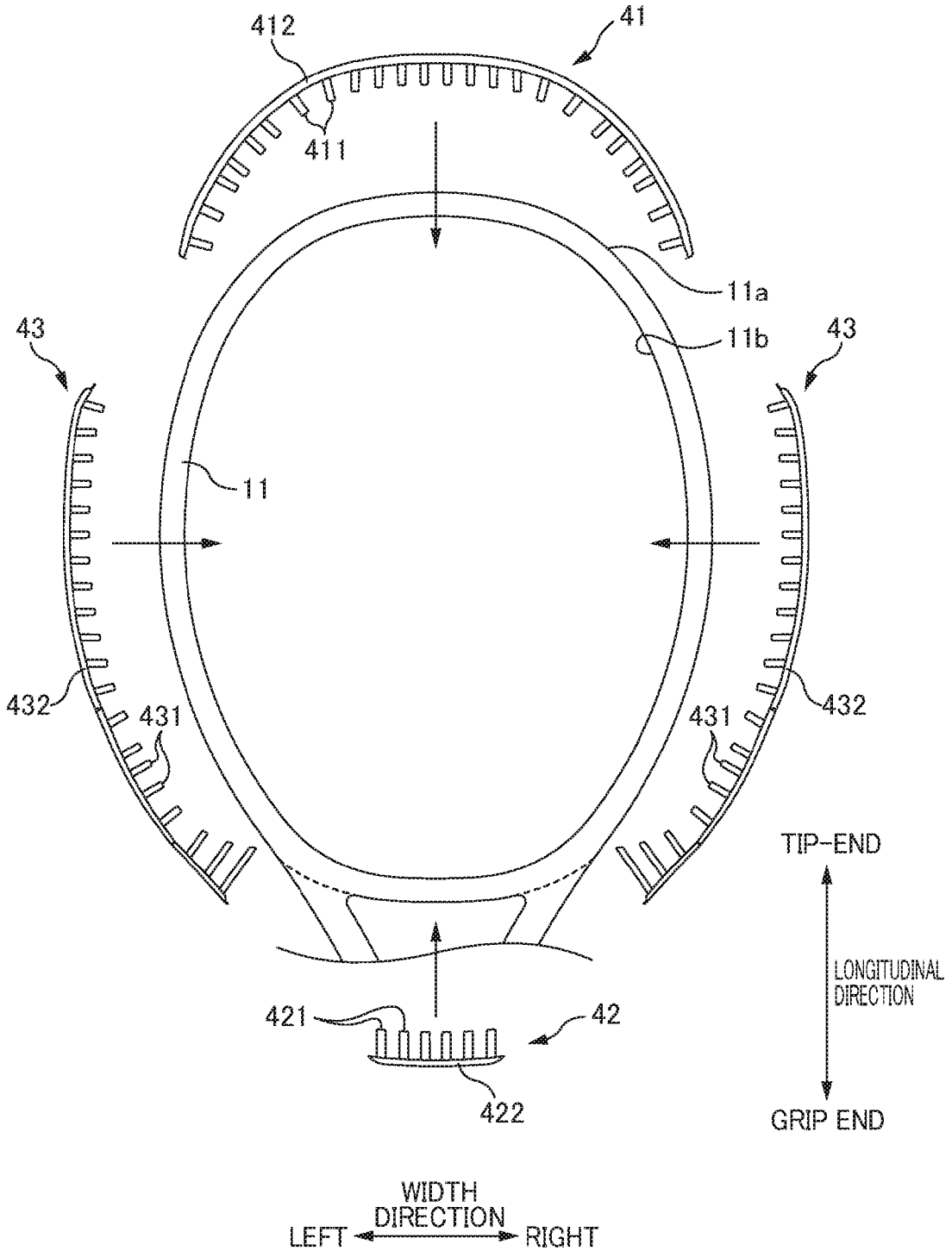
FIG. 3 is an explanatory diagram of each grommet to be attached to the frame 11.

FIG. 3 is an explanatory diagram of each grommet to be attached to the frame 11. In the racket 1 of the present embodiment, the bumper grommet 41, the yoke grommet 42 and the side grommet 43 are attached on the outer peripheral face 11*a* of the frame 11 as shown in FIG. 3. The strings 12 are strung to the frame 11 through the bumper grommet 41, the yoke grommet 42 and the side grommet 43, and this results in protecting the strings 12 and also damping vibrations when hitting the ball as well as providing the effects to be described later.

The bumper grommet 41 is attached to the tip portion in the longitudinal direction of the frame 11. Further, the yoke grommet 42 is attached to the grip-end side portion in the longitudinal direction of the frame 11. Further, the side grommets 43 are attached on the right and left in the width direction of the frame 11. Two side grommets are to be attached to the frame 11 because the side grommets 43 are attached on the right and left.

The bumper grommet 41 includes 24 tube sections 411 through which the string 12 is inserted and a strip-shaped base section 412 which connects these 24 tube sections 411. Note that, the bumper grommet 41 is provided with several types of tube sections (4111, 4112 and 4113 as reference numbers) as stated later. However, in FIG. 3, the tube section is shown with the reference number 411 as a collectively-called reference number of the tube section in the bumper grommet 41.

Further, the yoke grommet 42 includes six tube sections 421 through which the string 12 is inserted, and a strip-shaped base section 422 which connects these six tube sections 421.

Furthermore, the side grommet 43 includes 20 tube sections 431 through which the string is inserted, and a strip-shaped base section 432 which connects these 20 tube sections 431. Note that, the side grommet 43 is provided with several types of tube sections (4311, 4312 and 4313 as reference numbers) as stated later. However, in FIG. 3, the tube section is shown with the reference number 413 as a collectively-called reference number of the tube section in the bumper grommet 43.

Next, each grommet will be described in detail.

Figure 4A:
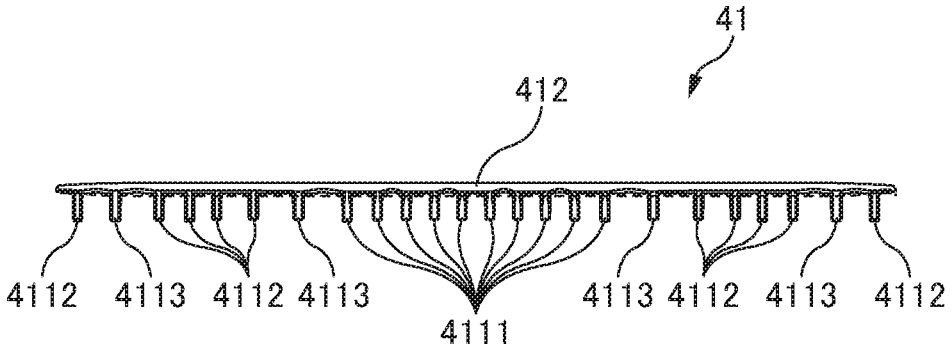
FIG. 4A is an explanatory diagram of a bumper grommet 41.

FIG. 4A is an explanatory diagram of the bumper grommet 41. The bumper grommet 41 has 10 first tube sections 4111, 10 second tube sections 4112, four third tube sections 4113, and the base section 412 which connects these tube sections. As stated later, the first tube section 4111 has an elongated hole shape in which an opening in the tip-end side of the communicating hole is formed wider in the arrangement direction of the tube sections 411 than an opening in the base section 412 side. On the other hand, the second tube section 4112 and the third tube section 4113 each have an opening in the tip-end side and an opening in the base section side, both of which are formed in a round hole shape. However, the second tube section 4112 and the third tube section 4113 differ from each other in their diameters. Two strings 12 are to be inserted through the third tube section 4113, and thus the diameter of the third tube section is larger than that of the second tube section 41*a*2 through which one string is inserted.

The bumper grommet 41 has a symmetrical shape, in which one second tube section 4112, one third tube section 4113, four second tube sections 4112, one third tube section 4113, and five first tube sections 4111 are arranged from the left end to the center in order.

Figure 4B:
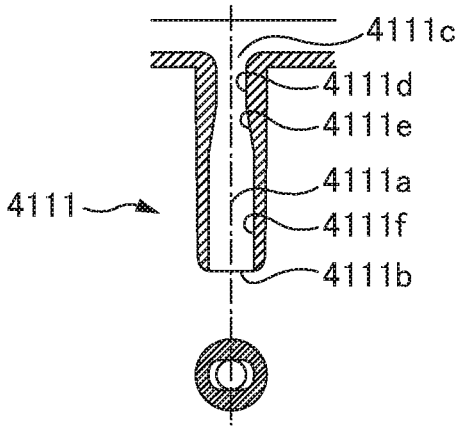
FIG. 4B is an enlarged cross-sectional view of a first tube section 4111 in the bumper grommet 41.

FIG. 4B is an enlarged cross-sectional view of the first tube section 4111 in the bumper grommet 41. FIG. 4B indicates a communicating hole 4111*a* in the first tube section 4111, a tip-end side opening 4111*b* of the communicating hole 4111*a*, and a base section side opening 4111*c* of the communicating hole 4111*a*.

The base section side opening 4111*c* of the communicating hole 4111*a* has a round hole shape. On the other hand, the tip end side opening 4111*b* of the communicating hole 4111*a* has an elongated hole shape having a longer diameter in the arrangement direction of the tube sections 411. Then, the longer diameter of the tip end side opening 4111*b* is wider than the diameter of the base section side opening 4111*c*. It is desirable that the longer diameter of the tip end side opening 4111*b* is set to be about one and a half times as large as the diameter of the base section side opening 4111*c*. However, setting to be about 1.2 to 2.0 times may also be applicable. Here, the diameter of the base section side opening 4111*c* is about 1.6 mm, and the longer diameter of the tip end side opening 4111*b* is about 2.4 mm.

In this way, to have different diameters between the tip end side opening 4111*b* and the base section side opening 4111*c* in the direction in which the tube sections 411 are arranged, a first straight part 4111*d*, an inclined part 4111*e*, and a second straight part 4111*f* are formed in the communicating hole 4111*a*. The diameter of the second straight part 4111*f* is larger than that of the first straight part 4111*d* in the arrangement direction of the tube sections 411, and the inclined part 4111*e* is provided to form such a shape.

Note that, the diameter (the shorter diameter) of the tip end side opening 4111*b* and the diameter of the base section side opening 4111*c* are formed in the same size in the thickness direction of the racket 1. Thus, the inclined part 4111*e* is not provided in the thickness direction of the racket 1.

Note that, the bumper grommet 41 includes 10 first tube sections 4111, and each longer diameter of the elongated holes of the tip end side openings 4111*b* of the first tube sections 4111 may be different from one another corresponding to the respective positions of the first tube sections 4111.

Figure 4C:
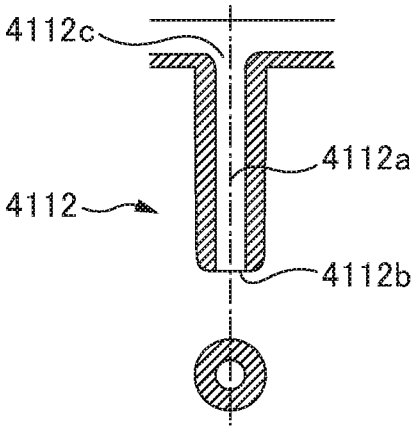
FIG. 4C is an enlarged cross-sectional view of a second tube section 4112 in the bumper grommet 41.

FIG. 4C is an enlarged cross-sectional view of the second tube section 4112 in the bumper grommet 41. FIG. 4C illustrates a communicating hole 4112*a* in the second tube section 4112, a tip end side opening 4112*b* of the communicating holes 4112*a* and a base section side opening 4112*c* of the communicating holes 4112*a*. The second tube section 4112 differs from the above-mentioned first tube section 4111. Both the tip end side opening 4112*b* and base section side opening 4112*c* have a round hole shape, and their respective diameters are also same with each other. That is, the communicating hole 4112*a* is a straight round hole.

Further, the diameter of the communicating holes 4112*a* in the second tube section 4112 is equal to the diameter of the base section side opening 4111*c* in the first tube section 4111 (here, about 1.6 mm as stated above). In this way, the diameter of the second tube section 4112 is sized to allow one string 12 to pass therethrough, so that the second tube section 4112 can appropriately support the longitudinal string 121.

Further, although the enlarged cross-sectional view of the third tube section 4113 is not shown, the third tube section 4113 also has the tip end side opening and the base section side opening, both of which have a round hole shape and the same diameter. That is, the communicating hole of the third tube section 4113 is also a straight round hole. However, the diameter of the communicating hole in the third tube section 4113 is larger than that of the communicating hole in the second tube section 4112. This is because two strings are to be inserted through the third tube section 4113.

Figure 5A:
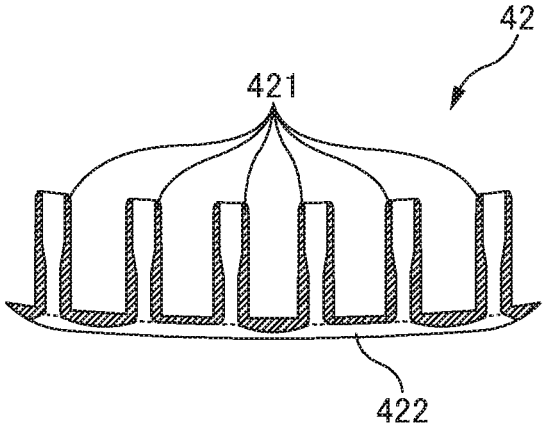
FIG. 5A is an explanatory diagram of a yoke grommet 42.

FIG. 5A is an explanatory diagram of the yoke grommet 42. The yoke grommet 42 includes four tube sections 421 and a base section 422 which connects these tube sections. The yoke grommet 42 also has a symmetrical shape. Further, the tube section 421 of the yoke grommet 42 has substantially the same shape as the first tube section 4111 in the above-mentioned bumper grommet 41.

Figure 5B:
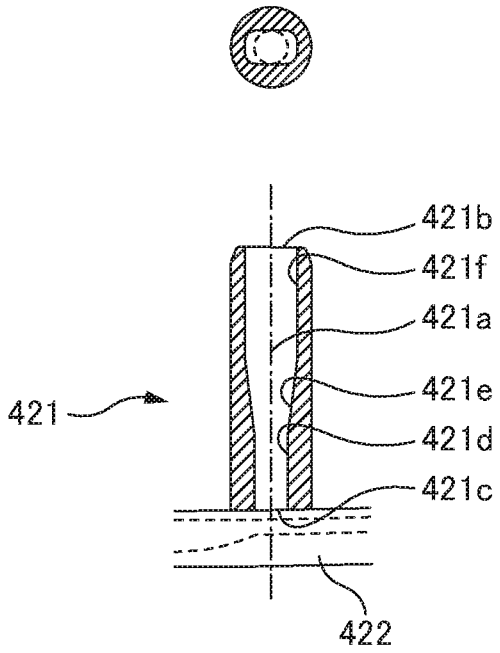
FIG. 5B is an enlarged cross-sectional view of a tube section 421 in the yoke grommet 42.

FIG. 5B is an enlarged cross-sectional view of the tube section 421 of the yoke grommet 42. FIG. 5B illustrates a communicating holes 421*a* in the tube section 421, a tip end side opening 421*b* of the communicating hole 421*a*, and a base section side opening 421*c* of the communicating hole 421*a*.

The base section side opening 421*c* of the communicating holes 421*a* has a round hole shape. On the other hand, the tip end side opening 421*b* of the communicating holes 421*a* has an elongated hole shape having a longer diameter in the arrangement direction of the tube sections 421. Then, the longer diameter of the tip end side opening 421*b* is greater than the diameter of the base section side opening 421*c*. It is desirable that the longer diameter of the tip end side opening 421*b* is set to be about one and a half times as large as the diameter of the base section side opening 421*c*.

However, setting to be about 1.2 to 2.0 times may also be applicable. Here, the diameter of the base section side opening 421*c* is about 1.8 mm, and the longer diameter of the tip end side opening 421*b* is about 2.8 mm.

To form such a shape, the tube section 421 includes a first straight part 421*d*, an inclined part 421*e* and a second straight part 421*f* as well.

Note that, the yoke grommet 42 includes 16 tube sections 421, and each longer diameter of the elongated holes of the tip end side openings 421*b* in the tube sections 421 may be different from one another corresponding to the respective positions of the tube section 421.

Figure 6A:
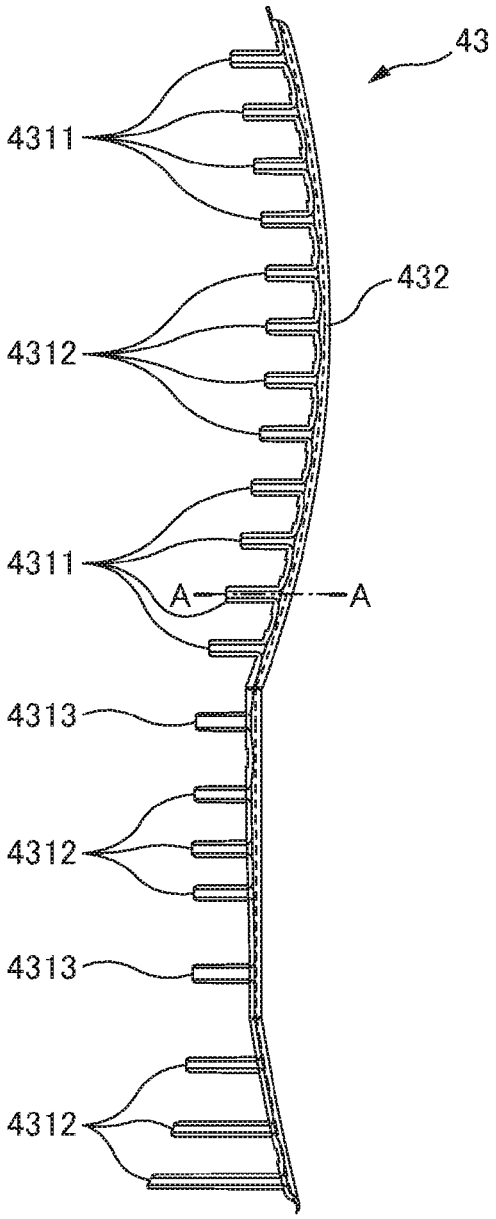
FIG. 6A is an explanatory diagram of a side grommet 43.

FIG. 6A is an explanatory diagram of the side grommet 43. The side grommet 43 includes eight first tube sections 4311, ten second tube sections 4312, two third tube sections 4313, and a base section 432 which connects these tube sections. As stated later, the tip end side opening 4311*b* of the first tube section 4311 has an elongated hole shape having a longer diameter in the thickness direction of the racket 1. Thus, the first tube section 4311 of the side grommet 43 has a different shape from the first tube section 4111 of the bumper grommet 41 and the tube section 421 of the yoke grommet 42 in terms of the direction of the longer diameter.

In the side grommet 43, four first tube sections 4311, four second tube sections 4312, four first tube sections 4311, one third tube section 4313, three second tube sections 4312, one third tube section 4313, and three second tube sections 4312 are arranged from the tip-end side to the grip end side of the frame 10 in order.

Figure 6B:
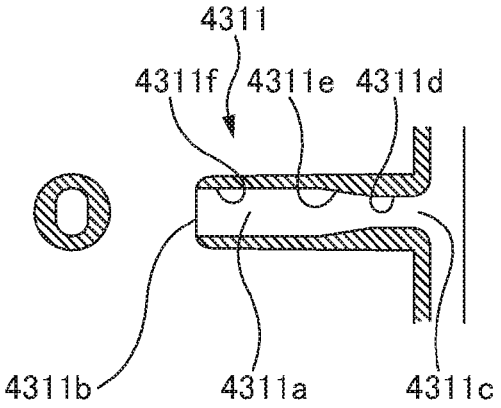
FIG. 6B is an enlarged cross-sectional view of a first tube section 4311 in the side grommet 43.

FIG. 6B is an enlarged cross-sectional view of the first tube section 4311 of the side grommet 43. FIG. 6B is a cross-sectional view taken along A-A in FIG. 6A. It should be noted that FIG. 6B differs from the cross-sectional views shown in the above-mentioned FIG. 4B and FIG. 5B in the cross-sectional direction. FIG. 6B illustrates a communicating holes 4311*a* in the first tube section 4311, a tip end side opening 4311*b* of the communicating hole 4311*a*, and a base section side opening 4311*c* of the communicating hole 4311*a*.

The base section side opening 4311*c* of the communicating hole 4311*a* has a round hole shape. On the other hand, the tip end side opening 4311*b* of the communicating hole 4311*a* has an elongated hole shape having a longer diameter in the thickness direction of the racket 1. Then, the tip end side opening 4311*b* is wider than the diameter of the base section side opening 4311*c*. It is desirable that the longer diameter of the tip end side opening 4311*b* is set to be about one and a half times as large as the diameter of the base section side opening 4311*c*. However, setting to be about 1.2 to 2.0 times may be applicable. Here, the diameter of the base section side opening 4311*c* is about 1.6 mm, and the longer diameter of the tip end side opening 4311*b* is about 2.4 mm.

Thus, to have different diameters in the thickness direction of the racket 1 between the tip end side opening 4311*b* and the base section side opening 4311*c*, a first straight part 4311*d*, an inclined part 4311*e* and a second straight part 4311*f* are formed in the communicating hole 4311*a*. The diameter of the second straight part 4311*f* is larger than that of the first straight part 4311*d* in the thickness direction of the racket 1, and the inclined part 4311*e* is provided to form such a shape.

Note that, the diameter (shorter diameter) of the tip end side opening 4311*b* and the diameter of the base section side opening 4311*c* are formed in the same size in the arrangement direction of the tube sections 431. Thus, the inclined part 4311*e* is not provided in the arrangement direction of the tube sections 431.

Note that, the side grommet 43 includes eight first tube sections 4311, and each longer diameter of the elongated holes of the tip end side openings 4311*b* in the first tube sections 4311 may be different from one another corresponding to the respective positions of the first tube sections 4311.

Figure 6C:
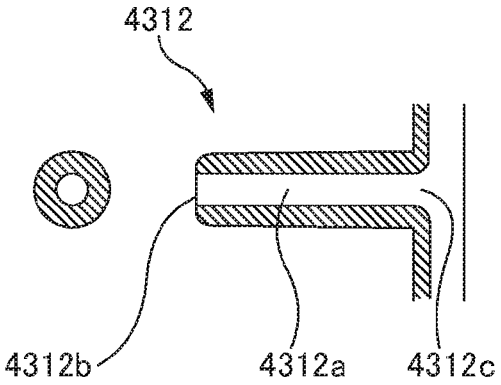
FIG. 6C is an enlarged cross-sectional view of a second tube section 4312 in the side grommet 42.

FIG. 6C is an enlarged cross-sectional view of the second tube section 4312 in the side grommet 43. FIG. 6C illustrates a communicating hole 4312*a* of the second tube section 4312, a tip end side opening 4312*b* of the communicating hole 4312*a*, and a base section side opening 4312*c* of the communicating hole 4312*a*. The second tube section 4312 differs from the foregoing first tube section 4311, and both the tip end side opening 4312*b* and base section side opening 4312*c* are round holes and also have the same diameter with each other. That is, the communicating hole 4312*a* is a straight communicating hole.

Further, the diameter of the communicating hole 4312*a* of the second tube section 4312 is equal to the diameter of the base section side opening 4311*c* of the first tube section 4311 (here, about 1.6 mm as stated above). In this way, the diameter of the second tube section 4312 is sized to allow one string 12 to be inserted therethrough, so that the second tube section 4312 can appropriately support the transverse string 122.

Further, although the enlarged cross-sectional view of the third tube section 4313 is not shown, the third tube section 4313 also has the tip end side opening and the base section side opening, both of which have a round hole shape and the same diameter. That is, the communicating hole of the third tube section 4313 is also a straight round hole. However, the diameter of the communicating hole of the third tube section 4313 is larger than that of the communicating hole of the second tube section 4312. This is because two strings are to be inserted through the third tube section 4313.

Figure 7:
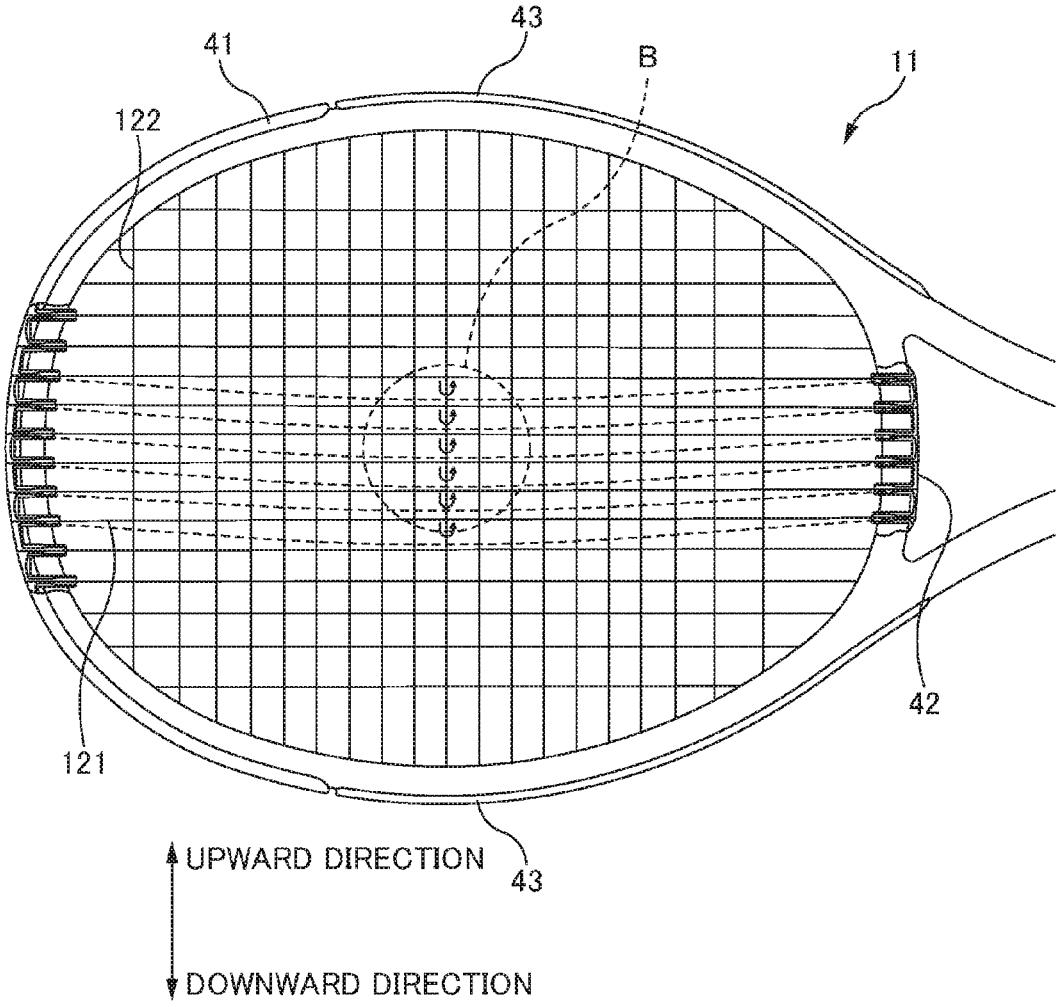
FIG. 7 is an explanatory diagram illustrating the movement of the strings when the ball is brought into contact with the strings.

FIG. 7 is an explanatory diagram illustrating the movement of the strings when the ball is brought into contact with the strings. FIG. 7 illustrates the frame 11 of the racket 1 and the strings 12 strung to the frame 11. Further, a ball B being brought into contact with the frame 11 is shown by a broken line, and then the displacement path of the longitudinal strings 121 when hitting the ball B so as to rub the ball upward is shown by solid lines with arrows. Moreover, the cross-sectional form of only the parts including the first tube sections 4111 of the bumper grommet 41 and the first tube sections 4311 of the yoke grommet 42 are shown to indicate the inside thereof. Further, an upward direction and a downward direction are shown in FIG. 7. The upward direction and the downward direction in FIG. 7 are defined as the upward and downward directions when swinging the racket, and thus it should be noted that those directions are different from the directions shown in FIG. 1 illustrating the racket 1.

When swinging the racket 1 and hitting the ball B back, a player generally swings the racket 1 so as to allow the racket 1 to rub the ball B upward (to allow the racket to move from downward to upward). Thus, a difference in atmospheric pressure between the upside and downside of the ball B occurs by rotating the ball B in the forward direction. When the ball B is rotating in the forward direction, the atmospheric pressure in the downside of the ball B becomes lower than the upside thereof. This makes the ball B easier to fall, rather than the case where the ball B is not rotated.

In FIG. 7, the longitudinal strings 121 shown by broken lines are illustrated along with the longitudinal strings 121 shown by solid lines. In the racket 1 of the present embodiment, the strings 12 shown by the broken lines indicate the longitudinal strings 121 which have been displaced when the strings have been brought into contact with the ball B. Also in the case of the racket 1 according to the present embodiment, when swinging the racket 1 as stated above, the longitudinal strings 121 which have been brought into contact with the ball B are displaced downward for a moment by hitting the ball B back so as to rub the ball upward. Then, the longitudinal strings 121 try to return to the original positions after being displaced downward.

According to the racket 1 to which the bumper grommet 41 of the present embodiment is attached, the tip end side opening 4111*b* of the first tube section 411 of the bumper grommet 41 is wider than the base section side opening 4111*c* in the direction in which a plurality of tube sections is arranged. Thus, when hitting a ball so as to rub the ball upward, the displacement of the longitudinal strings 121 of the racket 1 in the width direction becomes larger compared with that of a common racket. Further, when being displaced in the width direction, the longitudinal strings 121 move with a base section side opening 4111*c* side as a support point. Thus, the longitudinal strings 121 return to the original positions immediately after moving in the width direction, and this results in a larger amount of rotations of the ball. Specifically, the racket 1 having the foregoing configuration makes it possible to enlarge a movable range of the longitudinal strings 121, so that the number of rotations of the hit ball can be increased. Note that, the same applies to the racket 1 to which the yoke grommet 42 is attached.

Moreover, according to the racket 1 to which the bumper grommet 41 of the present embodiment is attached, the diameter of the tip end side opening 4111*b* and the diameter of the base section side opening 4111*c* are equal in the thickness direction of the racket 1, and thereby allowing the longitudinal strings 121 to move along the direction in which the plurality of tube sections 411 is arranged. Note that, the same applies to the racket 1 to which the yoke grommet 42 is attached.

Furthermore, according to the racket 1 to which the bumper grommet 41 of the present embodiment is attached, the diameter of the base section side opening 4111*c* is sized to allow one longitudinal string 12 to pass therethrough. Thus, the longitudinal strings 121 can be moved in the width direction of the racket 1 with the first straight part 4111*d* in the side of the base section side opening 4111*c* as a support point. For this reason, the longitudinal strings 121 can return to the original positions after being moved. Note that, the same applies to the racket 1 to which the yoke grommet 42 is attached.

If the first tube section 4111 of the bumper grommet 41, the tube section 421 of the yoke grommet 42, and the first tube section 4311 of the side grommet 43 are merely straight elongated holes, once the strings 121 move, the strings 12 slidably move in the elongated hole and become in a state of hardly returning to the original positions (in a state where the strings have approached one side). On the other hand, when the grommet of the present embodiment is used, the strings immediately return to the original positions even in a case where the strings have been brought into contact with the ball and then moved once.

Further, according to the racket 1 to which the side grommet 42 of the present embodiment is attached, when being in contact with the ball B, the transverse strings 122 can be largely moved in the thickness direction of the racket and then can be moved to the original positions. Although this allows a repulsive force of the ball B to be increased against the racket 1, a larger amount of rotation of the ball B in the forward direction can be achieved with such an above-mentioned configuration, and thereby allowing the ball to appropriately fall into the opponent's court.

Note that, when the side grommet 43 is fitted into the frame 11, the first tube sections 4311 are positioned slightly in the tip end side and the grip end side from the center. In this way, a higher repulsive force against the ball can be obtained without impairing hit feeling.

Next, effectiveness of providing a larger amount of rotation will be studied. With a swing machine, the difference in the amount of rotation is measured between the racket 1 of the present embodiment and the racket having communicating holes which are merely round holes in all tube sections of the grommet. In the results of the measurements, in a case where the amount of rotation of the ball against the racket that adopts the grommet having the communicating holes which are all merely round holes is 100, the amount of rotation when the ball is hit back by the racket 1 of the present embodiment is 110. That is, the amount of rotation can be increased by 10%.

Further, in a case where the amount of rotation of the ball is measured using the racket in which the bumper grommet 41 and the yoke grommet 42 of the present embodiment are adopted and only the side grommet has communicating holes of the tube sections which are all merely round holes, the amount of rotation is 105. That is, even in the case of using the racket which employs only the bumper grommet 41 and the yoke grommet 42 disclosed in the present embodiment, the amount of rotation can be increased by 5%.

===Other Embodiments===

The above-described embodiment is for facilitating understanding of the present invention, and is not intended to limit the interpretation of the present invention. As a matter of course, the present invention can be changed and modified without departing from the spirit of the invention, and equivalents thereof are encompassed in the present invention.

For example, both the bumper grommet 41 and the yoke grommet 42 are used in the above-mentioned embodiment. However, even in the case of using either one of them, the number of rotations of the hit ball can be increased due to the similar reason to the above.

Further, the tube sections 4311 of the side grommet 43 include the communicating holes widening in the thickness direction of the racket. However, the number of rotations of the hit ball can be increased by the effects of the bumper grommet 41 and the yoke grommet 42 without having such communicating holes in the side grommet 43.

Further, the above-mentioned embodiment is in a form that the grommet 40 is attached to the frame 11. However, the strings may be directly strung to the frame 11 without using the grommet 40.

In this case, the through hole in the frame of the racket includes an outer peripheral face side opening in the outer peripheral face side of the frame and an inner peripheral face side opening in the inner peripheral face side of the frame. Then, the inner peripheral side openings of at least some number of through holes, of the through holes through which the longitudinal strings of the racket are inserted, are wider than the outer peripheral side openings in the direction in which a plurality of through holes is arranged.

Even in such a racket, since the inner peripheral side openings are wider than the outer peripheral side openings in the direction in which the plurality of tube sections is arranged, the longitudinal strings can be easily moved more largely toward the intersecting direction when hitting a ball so as to rub the ball upward. Further, the longitudinal strings move with the outer peripheral side opening side as a support point, and thus the strings return to the original positions while being in contact with the ball immediately after moving to the intersecting direction. This increases the displacement of the longitudinal strings while being brought into contact with the ball in comparison with a common racket. The number of rotations of the hit ball can be increased with the foregoing racket because the number of rotations of the hit ball is increased corresponding to the displacement of the strings while being brought into contact with the ball.

Further, in the above-mentioned embodiment, a tennis racket is taken as an example of a racket associated with the present embodiment. However, the invention is not limited thereto. For example, the present embodiment may be applied to a squash racket, a badminton racket and the like. Also, in the above-mentioned embodiment, the racket 1 in which the strings 12 are strung inside the frame 11 is taken as an example of a racket. However, the invention is not limited thereto, and a racket in which the strings 12 have not been strung may also be employed.

Further, in the foregoing embodiment, the explanation was given on a case where the number of rotations in the forward direction of the ball was increased. However, the same effect will be achieved even in a case where the number of rotations in the backward direction of the ball is increased.

REFERENCE SIGNS LIST

1 racket, 10 head, 11 frame, 11*a* outer peripheral face, 11*b* inner peripheral face,
12 string, 13 string hole (through hole),
20 grip, 30 shaft,
31 base end portion, 32*a* first branched portion, 32 second branched portion, 33 opening,
41 bumper grommet, 42 yoke grommet, 43 side grommet, 44 groove section,
121 longitudinal string, 122 transverse string

The invention claimed is:

1. A racket comprising:

a grip;

an annular frame provided with a plurality of through holes extending through from an inner peripheral face to an outer peripheral face;

a shaft connecting the grip and the frame; and a grommet to be attached to the outer peripheral face of the frame, the grommet including:

a plurality of tube sections to be inserted into each of the plurality of through holes provided to the frame; and a base section that connects the plurality of tube sections to one another, the tube sections each including a communicating hole that communicates a base section side opening on the base section side with a tip end side opening on the side to be inserted through the through hole, the tip end side openings of at least some number of the tube sections, of the plurality of tube sections through which a string to be strung in a direction along a longitudinal direction of the racket is inserted, being wider than the base section side openings in a direction in which the plurality of tube sections is arranged, the base section side opening is a round hole, and the tip end side opening is an elongated hole having a longer diameter in a direction in which the tube sections are arranged.

2. A racket according to claim 1, wherein the grommet is attached to at least either one of the tip end side or the grip end side of the frame in the longitudinal direction.

3. A racket according to claim 1, wherein the size of the base section side opening and the size of the tip end side opening are equal with each other in a direction intersecting with the direction in which the tube sections are arranged.

4. A racket according to claim 1, wherein the racket further includes a side grommet having a plurality of tube sections through which the string to be strung along a direction intersecting with the longitudinal direction is inserted, and at least some number of the tube sections, of the tube sections of the side grommet, each have an elongated hole extending in the thickness direction of the racket.

5. A grommet to be attached to a racket, the racket including a grip, an annular frame provided with a plurality of through holes extending through from an inner peripheral face to an outer peripheral face, and a shaft connecting the grip and the frame, the grommet comprising:

a plurality of tube sections to be inserted into each of the plurality of through holes provided to the frame; and a base section that connects the plurality of tube sections to one another, the tube sections each including a communicating hole that communicates a base section side opening on the base section side with a tip end side opening on the side to be inserted through the through hole, the tip end side openings of at least some number of the tube sections, of the plurality of tube sections through which a string to be strung in a direction along a longitudinal direction of the racket is inserted, being wider than the base section side openings in a direction in which the plurality of tube sections is arranged, the base section side opening is a round hole, and the tip end side opening is an elongated in a direction in which the tube hole having a longer diameter sections are arranged.

* * * * *